US007556099B2

(12) United States Patent
Arthur et al.

(10) Patent No.: US 7,556,099 B2
(45) Date of Patent: Jul. 7, 2009

(54) RECOVERY PROCESS

(75) Inventors: John E. Arthur, Calgary (CA); Simon D. Gittins, Bragg Creek (CA); Harbir S. Chhina, Calgary (CA)

(73) Assignee: Encana Corporation, Calgary, Alberta (CA)

( * ) Notice: Subject to any disclaimer, the term of this patent is extended or adjusted under 35 U.S.C. 154(b) by 0 days.

(21) Appl. No.: 11/818,344

(22) Filed: Jun. 13, 2007

(65) Prior Publication Data

US 2007/0295499 A1 Dec. 27, 2007

Related U.S. Application Data

(60) Provisional application No. 60/813,995, filed on Jun. 14, 2006.

(51) Int. Cl.
*E21B 43/24* (2006.01)

(52) U.S. Cl. ..... 166/272.3; 166/303; 166/370; 166/372

(58) Field of Classification Search ..... None
See application file for complete search history.

(56) References Cited

U.S. PATENT DOCUMENTS 4,993,490 A 2/1991 Stephens et al.
5,244,041 A 9/1993 Renard et al.
5,273,111 A 12/1993 Brannan et al.
5,860,475 A 1/1999 Ejiogu et al.
6,257,334 B1 7/2001 Cyr et al.
2005/0082067 A1 4/2005 Good et al.

FOREIGN PATENT DOCUMENTS

CA 1130201 8/1982

OTHER PUBLICATIONS

Notification of Transmittal of the International Search Report, Written Opinion of the International Searching Authority, and International Search Report in corresponding International Application No. PCT/CA2007/001058 dated Sep. 28, 2007, 10 pp.

*Primary Examiner*—Zakiya W. Bates
(74) *Attorney, Agent, or Firm*—Haynes and Boone, LLP

(57) ABSTRACT

A method for recovering hydrocarbons from a subterranean reservoir by operating a first injector-producer well pair under a substantially gravity-controlled recovery process, the first injector-producer well pair forming a first mobilized zone, operating a second injector-producer well pair under a substantially gravity-controlled recovery process, the second injector-producer well pair forming a second mobilized zone, the first injector-producer well pair and the second injector-producer well pair together being the adjacent well pairs, providing an infill well in a bypassed region, the bypassed region formed between the adjacent well pairs when the first mobilized zone and the second mobilized zone merge to form a common mobilized zone, operating the infill well to establish fluid communication between the infill well and the common mobilized zone, operating the infill well and the adjacent well pairs under a substantially gravity-controlled recovery process, and recovering hydrocarbons from the infill well.

20 Claims, 2 Drawing Sheets

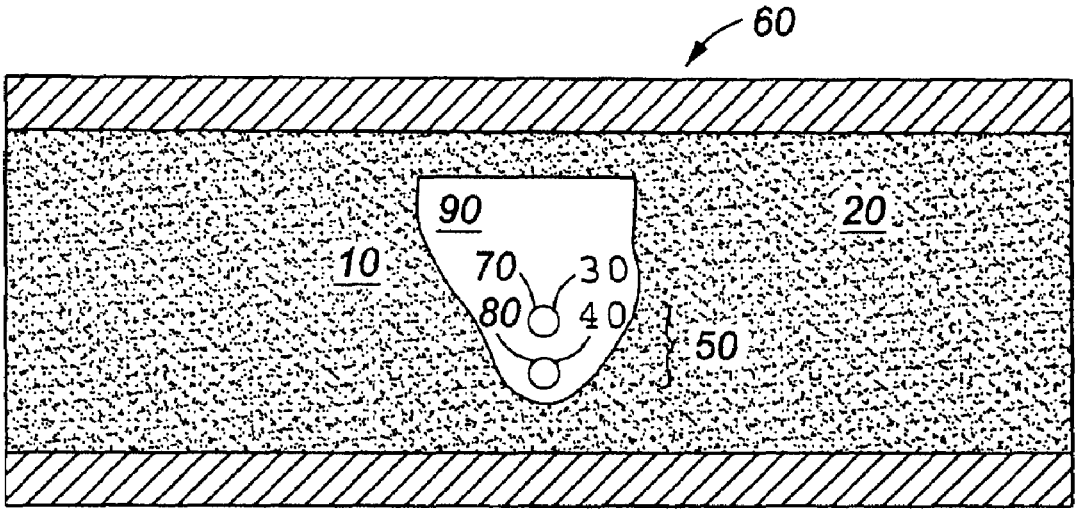
FIG. 1-Prior Art
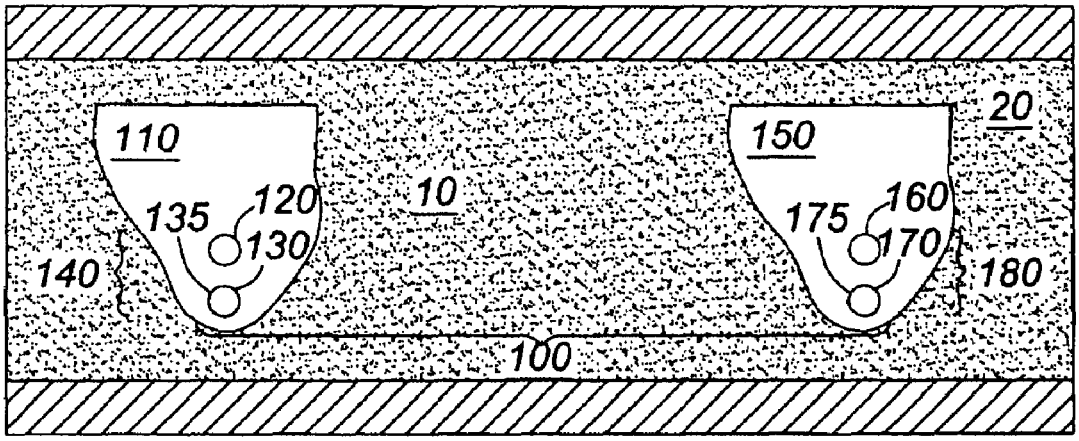
FIG. 2a-Prior Art
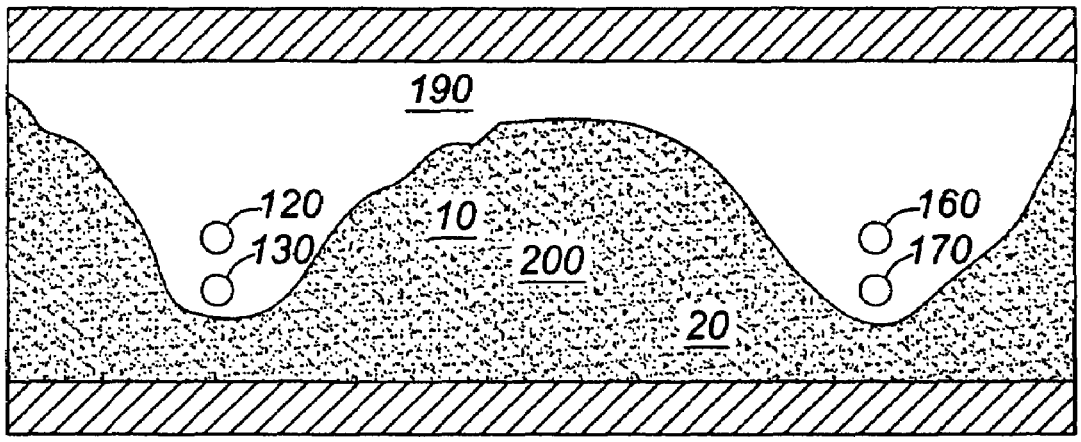
FIG. 2b-Prior Art

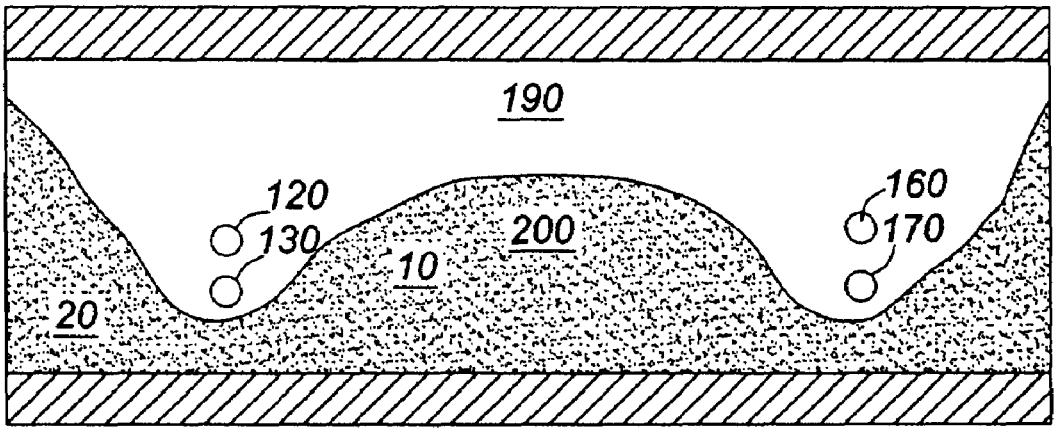
FIG. 2c-Prior Art
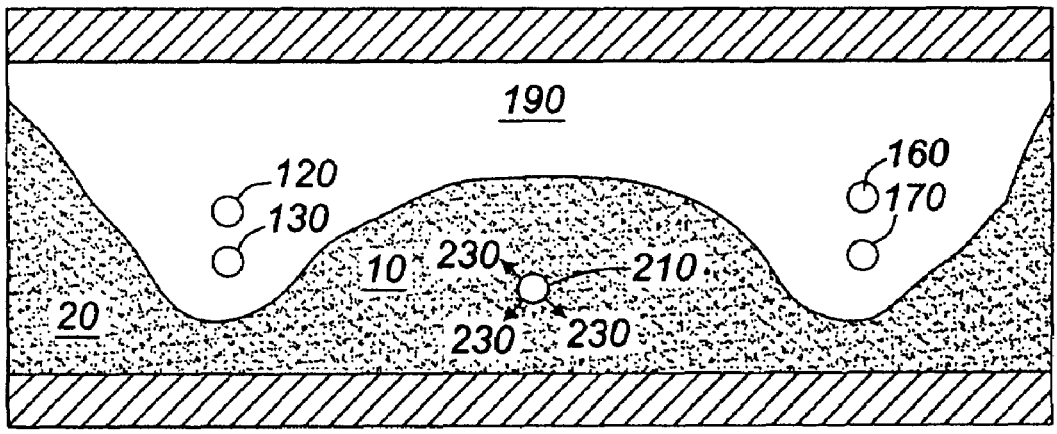
FIG. 3
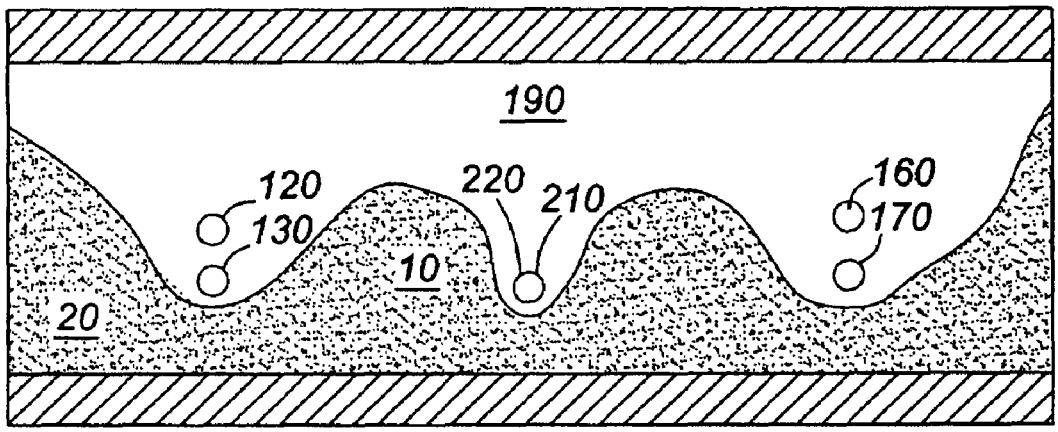
FIG. 4

RECOVERY PROCESS

CROSS REFERENCE TO RELATED APPLICATIONS

This application claims the benefit of priority of U.S. Provisional Patent Application No. 60/813,995 filed Jun. 14, 2006, which is incorporated herein by reference in its entirety.

FIELD OF THE INVENTION

The present invention relates generally to recovery processes for hydrocarbons from an underground reservoir or formation. More particularly, the present invention relates to recovery processes for heavy oil or bitumen from an underground reservoir or formation.

BACKGROUND OF THE INVENTION

A number of inventions are directed to the recovery of hydrocarbons from an underground reservoir or formation.

Canadian Patent No. 1,130,201 (Butler) teaches a thermal method for recovering normally immobile oil from a tar sand deposit utilizing two wells, one for injection of heated fluid and one for production of liquids. Thermal communication is established between the wells and oil drains continuously by gravity to the production well where it is recovered.

U.S. Pat. No. 6,257,334 (Cyr. et al.) teaches a thermal process for recovery of viscous oil from a subterranean reservoir. A pair of vertically spaced, parallel, co-extensive, horizontal injection and production wells and a laterally spaced, horizontal offset well are provided. The injection and production wells are operated as a Steam-assisted Gravity Drainage (SAGD) pair. Cyclic steam stimulation is practiced at the offset well. The steam chamber developed at the offset well tends to grow toward the steam chamber of the SAGD pair, thereby developing communication between the SAGD pair and the offset well. The offset well is then converted to producing heated oil and steam condensate under steam trap control as steam continues to be injected through the injection well.

SUMMARY OF THE INVENTION

It is an object of the present invention to obviate or mitigate at least one disadvantage of previous recovery processes.

Generally, the present invention relates to a method or process for recovery of viscous hydrocarbons from a subterranean reservoir of said hydrocarbons, the subterranean reservoir having been penetrated by wells that have or had been operating under a gravity-controlled recovery process, such as, but not limited to, Steam Assisted Gravity Drainage, commonly referred to as SAGD. In the context of the present invention, and consistent with current practice of the art, such as field operation of the SAGD process, reference to a gravity-controlled recovery process implies a process whose flow mechanisms are predominantly gravity-controlled and whose techniques of operation are largely oriented toward ultimately maximizing the influence of gravity control because of its inherent efficiency.

The invention involves placement and operation of a well or wells, referred to as the infill well or infill wells in the subterranean reservoir where the principal or initial recovery mechanism is a gravity-controlled process such as, but not limited to, SAGD, so as to access that portion of said reservoir whose hydrocarbons have not or had not been recovered in the course of operation of the prior configuration of wells under the abovementioned gravity-controlled recovery process, referred to herein as the bypassed region.

Following operation of the gravity-controlled recovery process for a suitable period of time using the prior configuration of wells, also referred to herein as the adjacent well pairs, the infill well is activated. The principle that underlies the choice of timing of activation of the infill well in relation to operation of the prior wells involves ensuring that the mobilized zones surrounding the adjacent wells have first formed a single hydraulic entity prior to activation of the infill well so that it can access that mobilized zone.

In a first aspect, the present invention provides a method of producing hydrocarbons from a subterranean reservoir, by operating a first injector-producer well pair under a substantially gravity-controlled recovery process, the first injector-producer well pair forming a first mobilized zone in the subterranean reservoir, operating a second injector-producer well pair under a substantially gravity-controlled recovery process, the second injector-producer well pair forming a second mobilized zone in the subterranean reservoir, the first injector-producer well pair and the second injector-producer well pair together being the adjacent well pairs, providing an infill well in a bypassed region, the bypassed region formed between the adjacent well pairs when the first mobilized zone and the second mobilized zone merge to form a common mobilized zone, operating the infill well to establish fluid communication between the infill well and the common mobilized zone, operating the infill well and the adjacent well pairs under a substantially gravity-controlled recovery process, and recovering hydrocarbons from the infill well.

Preferably, hydrocarbon is produced from the infill well to establish fluid communication between the infill well and the common mobilized zone.

Preferably, a mobilizing fluid is injected into the infill well to establish fluid communication between the infill well and the common mobilized zone. Preferably, a mobilizing fluid is circulated though the infill well to establish fluid communication between the infill well and the common mobilized zone.

Preferably, the mobilizing fluid comprises steam. Preferably, the mobilizing fluid is substantially steam. Preferably, the mobilizing fluid is a light hydrocarbon or a combination of light hydrocarbons. Preferably, the mobilizing fluid includes both steam and a light hydrocarbon or light hydrocarbons either as a mixture or as a succession or alternation of fluids. Preferably, the mobilizing fluid comprises hot water. Preferably, the mobilizing fluid comprises both hot water and a light hydrocarbon or light hydrocarbons, introduced into the hydrocarbon formation either as a mixture or as a succession or alternation of fluids.

Preferably, the mobilizing fluid is injected at a pressure and flow rate sufficiently high to effect a fracturing or dilation or parting of the subterranean reservoir matrix outward from the infill well, thereby exposing a larger surface area to the mobilizing fluid.

Preferably, the injection of the mobilizing fluid is terminated or interrupted, and a gaseous fluid is injected into the common mobilized zone to maintain pressure within the common mobilized zone, while continuing to produce hydrocarbons under a predominantly gravity-controlled recovery process. Preferably, the mobilizing fluid and the gaseous fluid are injected concurrently. Preferably, the gaseous fluid comprises natural gas.

Preferably, the gravity-controlled recovery process comprises Steam-assisted Gravity Drainage (SAGD). Preferably, the infill well and the adjacent well pairs are substantially horizontal. Preferably the trajectories of the substantially horizontal infill well and the adjacent well pairs are approximately parallel. Preferably, the adjacent well pairs comprise a substantially horizontal completion interval, and a series of substantially vertical infill wells are placed with completion intervals along at least a portion of the adjacent well pairs.

Preferably, the infill well and the adjacent well pairs, constituting a well group, are provided on a repeated pattern basis either longitudinally or laterally or both, to form a multiple of well groups.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 1 is a cross-section view of a subterranean formation, depicting a single injector-producer well pair in a subterranean formation utilizing a SAGD recovery process (prior art);

FIG. 2*a*-2*c* is a cross-section view, as in FIG. 1, depicting a plurality of adjacent injector-producer well pairs in a subterranean formation utilizing a SAGD recovery process (prior art), depicting the progression over time;

FIG. 3 is a cross-section view, as in FIG. 2, depicting an embodiment of the present invention (infill well not yet in fluid communication with the common mobilized zone); and FIG. 4 is a cross-section view, as in FIG. 2, depicting an embodiment of the present invention (infill well in fluid communication with the common mobilized zone).

DETAILED DESCRIPTION

Generally, the present invention relates to a process for recovering viscous hydrocarbons, such as bitumen or heavy oil, from a subterranean reservoir which is, or had been, subject to a gravity-controlled recovery process, and which gravity-controlled recovery process was resulting or had resulted in the bypassing of hydrocarbons in a bypassed region due to the imperfect sweep efficiency or conformance of the flow patterns of said process or for other reasons.

At least one well, referred to in its singular embodiment as the infill well, is completed in a completion interval in the bypassed region where hydrocarbons have been bypassed by a gravity-controlled recovery process, and thereafter mobilizing the hydrocarbon in those otherwise-bypassed regions in such a way that the infill well achieves and remains in hydraulic communication with adjacent gravity-controlled patterns. The timing of activation of the infill well is such that the adjacent well pairs have first operated for a sufficient period of time to ensure that their surrounding mobilized zones have merged to form a single hydraulic entity, after which time the infill well can be operated so as to access that entity. The infill well and adjacent wells are then operated in aggregate as a hydraulic and thermal unit so as to increase overall hydrocarbon recovery. Specifically, the infill well, through its communication with adjacent patterns, is able to recover additional hydrocarbons by providing an offset means of continuing the gravity drainage process originally implemented in those adjacent patterns.

Referring to FIG. 1 by way of example, typically the principal or initial gravity-controlled recovery process for the recovery of viscous hydrocarbons, such as bitumen or heavy oil 10 from a subterranean reservoir 20 will involve an injection well 30 and a production well 40, commonly referred to as an injector-producer well pair 50 with the production well 40 directly underlying the injection well 30. The injection well 30 extends between the surface 60 and a completion interval 70 in the subterranean reservoir 20, forming an injection well trajectory. The production well 40 extends between the surface 60 and a completion interval 80 in the subterranean reservoir 20, forming a production well trajectory. Typically, the injection well trajectory and the production well trajectory are generally parallel, at least in a substantial portion of their respective completion intervals. As one skilled in the art will recognize, the figures herein represent the completion intervals of the wells only, as is customary to one skilled in the art.

The vertical interval or space between the injection well 30 and the production well 40 is dictated by practices already well known to one skilled in the art when, for example, SAGD is the process. A mobilized zone 90 extends between the injection well 30 and the production well 40 and into the subterranean reservoir 20.

FIG. 2 illustrates a typical progression over time of adjacent horizontal well pairs 100 as the gravity-controlled process continues to be operated throughout its various stages. A first mobilized zone 110 extends between a first injection well 120 and a first production well 130 completed in a first production well completion interval 135 and into the subterranean reservoir 20, the first injection well 120 and the first production well 130 forming a first injector-producer well pair 140. A second mobilized zone 150 extends between a second injection well 160 and a second production well 170 completed in a second production well completion interval 175 and into the subterranean reservoir 20, the second injection well 160 and the second production well 170 forming a second injector-producer horizontal well pair 180.

Thus, as illustrated in FIG. 2*a,* the first mobilized zone 110 and the second mobilized zone 150 are initially independent and isolated from each other, with no fluid communication between the first mobilized zone 110 and the second mobilized zone 150.

Over time, as illustrated in FIG. 2*b,* lateral and upward progression of the first mobilized zone 110 and the second mobilized zone 150 results in their merger, resulting in fluid communication between the first mobilized zone 110 and the second mobilized zone 150, referred to herein as a common mobilized zone 190.

Referring to FIG. 2*c,* at some point the economic life of the gravity-controlled recovery process comes to an end, due to an excessive amount of steam or water produced or for other reasons. As illustrated in FIG. 2*c,* a significant quantity of hydrocarbon in the form of the bitumen or heavy oil 10 remains unrecovered in a bypassed region 200 situate between the adjacent horizontal well pairs 100.

Referring to FIG. 3, a horizontal infill well 210 is completed in a completed interval 220 in the bypassed region 200. The location and shape of the bypassed region 200 may be determined by computer modeling, seismic testing, or other means known to one skilled in the art.

While shown as horizontal, the infill well 210 may be vertical or horizontal or slanted or combinations thereof. Typically, the horizontal infill well 210 will have a completion interval 220 within the bypassed region 200 and will be at a level or depth which is comparable to that of the adjacent horizontal production wells, first production well 130 and second production well 170, having regard to constraints and considerations related to lithology and geological structure in that vicinity, as is known to one ordinarily skilled in the art.

The infill well 210 is typically, though not necessarily, a horizontal well whose trajectory is generally parallel, at least in the completion interval 220, to the adjacent injector-producer well pairs 100 that are operating under a gravity-controlled process. Also typically, the completion interval 220 of the horizontal infill well 210 is situated vertically at more or less the same elevation or depth as the first production well completion interval 135 or the second production well completion interval 175. Alternatively, the infill well 210, may be a vertical well, slanted well, or any combination of horizontal and vertical wells.

Timing of the inception of operations at the infill well 210 may be dictated by economic considerations or operational preferences. Thus, in some circumstances it may be appropriate to initiate the operation of the infill well 210 after the adjacent well pairs 100 are at or near the end of what would be their economic lives if no further action were taken. In other circumstances, however, it may be advisable to initiate the operation of the infill well 210 at a distinctly earlier stage in the life of the adjacent well pairs 100. However, a key feature of the present invention is that the linking or fluid communication between the infill well 210 and the common mobilized zone 190 must await the merger of the first mobilized zone 110 the second mobilized zone 150 (which forms the common mobilized zone 190).

If the bypassed region 200 surrounding the infill well 210 contains mobile hydrocarbons, the infill well 210 may be placed on production from the outset. Hydrocarbons may be produced from the infill well 210 either through a cyclic, continuous, or intermittent production process. Over time, fluid communication is established and/or increased between the completion interval 220 of the infill well 210 and the common mobilized zone 190 (see FIG. 4).

Typically, the completion interval 220 of the infill well 210 in the bypassed region 200 will not initially experience hydrocarbons that have been mobilized to any sufficient degree. If there are no mobile hydrocarbons or subsequent to producing the mobile hydrocarbons from the third mobilized zone, a mobilizing fluid, or fluid combination, may be injected into the infill well 210 either through a cyclic, continuous, or intermittent injection process, or by circulation. Over time, fluid communication is established and/or increased between the completion interval 220 of the infill well 210 and the common mobilized zone 190 (see FIG. 4).

The infill well 210 may be used for a combination of production and/or injection. That is, the injection well 210 may be used to inject the mobilizing fluid into the subterranean reservoir 20 or the injection well 210 may be used to produce the hydrocarbon in the form of bitumen or heavy oil 10 from the subterranean reservoir 20 or both.

The manner in which the mobilizing fluid 230 is injected into the infill well 210 may vary depending on the situation. For example, a cyclic stimulation approach can be used whereby injection of the mobilizing fluid 230 is followed by production from the infill well 210 thereby ultimately creating a pressure sink which will tend to draw in mobilized fluids from the common mobilized zone 170 and thereby establish hydraulic communication between the infill well 210 and the common mobilized zone 170. Alternatively, a mobilizing fluid 230 could be injected into the infill well 210 on a substantially continuous or intermittent basis until a suitable degree of communication between the infill well 210 and the common mobilized zone 190 is attained.

When the infill well 210 and the common mobilized zone 190 have attained a suitable level of fluid communication, the extension of the gravity-controlled recovery process to include the infill well 210 as a production well may begin. Any attempt to establish fluid communication between the infill well 210 and the adjacent well pairs 100 preferably must await the prior merger of the mobilized zones of those adjacent well pairs (the first mobilized zone 110 and the second mobilized zone 150 of FIG. 2*a*). That is, only after the first mobilized zone 110 and the second mobilized zone 150 merge to form the common mobilized zone 190 as a single hydraulic entity is the linkage with the infill well effected.

If the infill well 210 is activated too early relative to the depletion stage of the adjacent well pairs operating under a gravity-controlled process, the infill well 210, though possibly capable of some production, will not necessarily share in the benefits of being a producer in a gravity-controlled process. That is, premature activation of an infill well may prevent or inhibit hydraulic communication, or may result in communication in which the flow from the adjacent well pairs to the infill well is due to a displacement mechanism rather than to a gravity-control mechanism. To the extent that a displacement mechanism is operative at the expense of a gravity-control mechanism, recovery efficiency will be correspondingly compromised if the infill well 210 is converted from an injection well to a production well before the common mobilized zone 190 is established.

FIG. 4 illustrates the common mobilized zone 190 after the infill well 190, which in this example is a horizontal well, has achieved hydraulic communication with the already communicating adjacent well pairs 100.

The infill well 210 is then produced predominantly by gravity drainage, typically along with continued operation of the adjacent first injector-producer well pair 140 and the second injector-producer well pair 180 that are also operating predominantly under gravity drainage. The infill well 210, although offset laterally from the overlying first injection well 120 and the second injection well 160, is nevertheless able to function as a producer that operates by means of a gravity-controlled flow mechanism much like the adjacent well pairs. This is because inception of operations at the infill well 210 is designed to foster fluid communication between the infill well 210 and the adjacent well pairs 100 so that the aggregate of both the infill well 210 and the adjacent well pairs 100 function effectively as a unit under a gravity-controlled recovery process.

The net result of operating the infill well, along with adjacent communicating gravity-controlled wells, is a material increase in recovered hydrocarbon over that which would have been achieved had the infill well not been present, all of which is achieved in the Subject Invention under the dominance of a high efficiency gravity-controlled flow mechanism. Furthermore, this material increase in recovered hydrocarbon is achieved while not increasing and in most instances decreasing the cumulative steam-oil ratio.

The present invention applies to any known heavy oil deposits and to oil sands deposits, for example, those in the Foster Creek oil sand deposit, Alberta, Canada, where the horizontal infill well 210 has achieved hydraulic communication with adjacent SAGD horizontal well pairs that had been in prior communication, and the aggregate of wells is operating as a unit under gravity-controlled flow.

Performance of the present invention has been simulated mathematically for the case of horizontal wells with steam as the mobilizing fluid. TABLE 1 compares the performance at three different stages of recovery of:

the SAGD process with no infill wells;

the present invention; and the invention described in U.S. Pat. No. 6,257,334 for exemplary purposes only.

TABLE 1

| RECOVERY | CUMULATIVE STEAM-OIL RATIO | | | AVERAGE CALENDAR DAY OIL RATE, M3/DAY | | |
|---|---|---|---|---|---|---|
| FACTOR % OF OOIP | No Infill | Subject Invention | U.S. Pat. No. 6,257,334 B1 | No Infill | Subject Invention | U.S. Pat. No. 6,257,334 B1 |
| 40 | 2.65 | 2.25 | 2.56 | 188 | 217 | 192 |
| 50 | 2.75 | 2.0 | 2.76 | 165 | 207 | 177 |
| 60 | 3.2 | 2.3 | 2.98 | 140 | 159 | 158 |

As indicated, at recovery efficiencies of 40%, 50% and 60%, the cumulative steam-oil ratio of the present invention is markedly lower than the corresponding values for both the SAGD process with no infill well and the invention described in U.S. Pat. No. 6,257,334. At the same time, the average calendar day oil rate of the Subject Invention is as high as or higher than the corresponding values for the other two processes.

As noted below, a preferred embodiment of the present invention involves termination or interruption of steam injection with subsequent injection of a gas. The injection of a gas, such as but not restricted to natural gas, following steam injection helps to maintain pressure so that heated oil within the common mobilized zone 190 may be produced without need of additional steam injection at excessive steam-oil ratios. This gas injection follow-up to steam injection in a SAGD operation is applicable to the present invention, as well as conventional SAGD operation.

Mathematical model results for the process of steam injection with gas follow-up indicate that the present invention continues to demonstrate a significant advantage over the comparable process involving no infill wells. Thus, for example, in the case of no infill wells, at a 50% recovery efficiency, the process of steam followed by gas injection yields a cumulative steam-oil ratio of 1.6. Thus, when compared with TABLE 1, even without infill wells the use of gas as a follow-up to steam injection lowers the cumulative steam-oil ratio to 1.6 from 2.75. However, when the method of the present invention is utilized, recovery efficiency increases to 58% at a comparable or slightly reduced cumulative steam oil ratio of 1.5. Note that the method of the present invention with the embodiment involving follow-up gas injection shows an improvement in performance over the embodiment of the present invention involving steam injection only as presented in TABLE 1.

Thus, in summary, as illustrated in TABLE 1, the present invention, when employed in that embodiment which involves steam injection only, demonstrates a significant improvement in performance over both the process of no infill wells and the process embodied in U.S. Pat. No. 6,257,334. Furthermore, when the embodiment employed involves the injection of a gas as a follow-up to steam injection, the present invention provides a significant advantage over the comparable process with no infill wells.

In the preferred embodiment of this invention, the mobilizing fluid 230 is predominantly steam, and the first production well 130 and the second production well 170 are substantially horizontal. Preferably, the gravity-controlled process under which the adjacent well pairs 100 operate is SAGD. As such, the production well is offset from the injection well in a substantially vertical direction by an interval whose magnitude is determined by those skilled in the art. Unless otherwise constrained by lithologic or structural considerations, the horizontal infill well would be of a length comparable to those of the initial SAGD wells and would be substantially parallel to them. Placement of the infill well 210 would be dictated by the stage of depletion of the SAGD mobilized zones, otherwise referred to as SAGD chambers, again constrained by considerations of lithology and structure.

Operation of the horizontal infill well 210 would be initiated having regard to the economically optimum time to begin capture of the otherwise unrecovered hydrocarbon in the bypassed region. Typically, cyclic steam stimulation would be initiated at the infill well 210, with the size of cycle estimated based on design considerations relating to attainment of hydraulic communication between the infill well 210 and the adjacent injector-producer well pairs, which well pairs would already be in communication with each other through their merged mobilized zones, forming the common mobilized zone 190.

At the outset of infill well operations, there may be insufficient mobility in the reservoir surrounding the infill well to permit steam injection into the reservoir matrix at practical rates without disrupting the fabric of the reservoir matrix. In this event, those practiced in the art will recognize that alternative modes of achieving hydraulic communication with the adjacent common mobilized zone 190 are available. One such mode involves injecting into the infill well 210 at sufficiently high pressures to effect a parting, dilation or fracturing of the subterranean reservoir matrix, thereby exposing a larger area across which flow into the hydrocarbon formation can take place. Another mode involves circulating steam within the tubulars of the infill well 210 to heat the surrounding hydrocarbon formation initially by conduction. In some hydrocarbon formations, the water saturation within the reservoir matrix may be sufficiently high to provide a high mobility path along which hydraulic communication may be easily established without need of high pressure techniques.

It should be noted that while a preferred embodiment of this invention involves a horizontal infill well 210 which is approximately parallel to the horizontal adjacent production well and injection well, this need not be the case. For example, the infill well 210 could be drilled so that it is not parallel to the adjacent well pairs, for example the infill well may be oriented at right angles or some other angle to a group of adjacent well pairs.

In another embodiment, the infill well 210 may be located and oriented so that it captures oil that is located in or proximate the region of the heels of the adjacent horizontal well pairs 100.

In another embodiment, instead of, or in addition to, a horizontal infill well 210, one may choose to drill a group of vertical wells which are completed appropriately so that, in aggregate, they perform the same type of function as an equivalent horizontal infill well. That is, they achieve communication with adjacent wells that are themselves in prior hydraulic communication forming a common mobilized zone, and they facilitate recovery of oil under a predominantly gravity-controlled process that would have otherwise been by-passed. For example, one might elect to use this type of well configuration in those instances where the previously by-passed oil that is to be recovered is distributed in a non-uniform or irregular manner so that one or more selectively placed vertical infill wells 210 may capture oil more efficiently than would a horizontal infill well 210.

A feature of the recovery process described in the present invention is the continuation of a dominant gravity control mechanism after fluid communication has been established between the infill well 210 and the adjacent well pairs 100, which adjacent well pairs 100 are themselves already in communication via the common mobilized zone 190. Thus, instead of SAGD, some other analogous gravity-controlled process might be utilized. Typically, such a process might employ a combination, or range of combinations, of light hydrocarbons and heated aqueous fluid. Irrespective of the particular combination of such injected fluids, the salient feature of the method of the present invention would be the establishment of hydraulic communication between an infill well and the adjacent well pairs, which adjacent well pairs are themselves already in communication, and the subsequent integrated operation of the aggregate of wells under a predominantly gravity-controlled process.

It is known to those practiced in the art that a gravity-controlled process utilizing a particular mobilizing fluid, such as steam in the case of SAGD, or a set of mobilizing fluids in place of a single fluid, need not continue to use those fluids, or need not continue to use those fluids exclusively, throughout the life of the process wells. Thus, for example, in the case of SAGD, it is often prudent to curtail or even halt the injection of steam at a certain point in the life of the process, and inject an alternative or concurrent fluid, such as natural gas, all the while maintaining gravity control. The net effect of this type of operation is a sustenance of productivity relative to that achievable if steam injection is simply terminated, and a consequent increase in energy efficiency as a result of the reduction in cumulative steam-oil ratio. In the case of natural gas injection, this technique will affect the pressure and temperature distribution within the chambers, and between them if they are in communication. However, the fundamental nature of the recovery process as one which is dominated by a gravity-controlled mechanism remains unchanged. Thus, in this type of situation, with alternative or concurrent fluid injection, the placement and operation of an infill well in the manner described above, with eventual establishment of an aggregate of wells that are in hydraulic communication and functioning predominantly under gravity control, will represent another variation of the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method of producing hydrocarbons from a subterranean reservoir, comprising:

a. operating a first injector-producer well pair under a substantially gravity-controlled recovery process, the first injector-producer well pair forming a first mobilized zone in the subterranean reservoir;

b. operating a second injector-producer well pair under a substantially gravity-controlled recovery process, the second injector-producer well pair forming a second mobilized zone in the subterranean reservoir, the first injector-producer well pair and the second injector-producer well pair together being the adjacent well pairs;

c. providing an infill producer well in a bypassed region, the bypassed region formed between the adjacent well pairs when the first mobilized zone and the second mobilized zone merge to form a common mobilized zone;

d. operating the infill producer well to establish fluid communication between the infill producer well and the common mobilized zone;

e. operating the infill producer well and the adjacent well pairs under a substantially gravity-controlled recovery process; and f. recovering hydrocarbons from the infill producer well.

2. The method of claim 1, wherein hydrocarbon is produced from the infill producer well to establish fluid communication between the infill producer well and the common mobilized zone.

3. The method of claim 1, wherein a mobilizing fluid is injected into the infill producer well to establish fluid communication between the infill producer well and the common mobilized zone.

4. The method of claim 3, wherein the mobilizing fluid comprises steam.

5. The method of claim 4, wherein the mobilizing fluid is substantially steam.

6. The method of claim 3, wherein the mobilizing fluid is a light hydrocarbon or a combination of light hydrocarbons.

7. The method of claim 3, wherein the mobilizing fluid includes both steam and a light hydrocarbon or light hydrocarbons either as a mixture or as a succession or alternation of fluids.

8. The method of claim 3, wherein the mobilizing fluid comprises hot water.

9. The method of claim 3, wherein the mobilizing fluid comprises both hot water and a light hydrocarbon or light hydrocarbons, introduced into the hydrocarbon formation either as a mixture or as a succession or alternation of fluids.

10. The method of claim 3, wherein the mobilizing fluid is injected at a pressure and flow rate sufficiently high to effect a fracturing or dilation or parting of the subterranean reservoir matrix outward from the infill producer well, thereby exposing a larger surface area to the mobilizing fluid.

11. The method of claims 3, wherein the injection of the mobilizing fluid is terminated or interrupted, and a gaseous fluid is injected into the common mobilized zone to maintain pressure within the common mobilized zone, while continuing to produce hydrocarbons under a predominantly gravity-controlled recovery process.

12. The method of claim 11, wherein the mobilizing fluid and the gaseous fluid are injected concurrently.

13. The method of claim 11, wherein the gaseous fluid comprises natural gas.

14. The method of claim 1, wherein a mobilizing fluid is circulated through the infill producer well to establish fluid communication between the infill producer well and the common mobilized zone.

15. The method of claim 14, wherein the mobilizing fluid comprises steam.

16. The method of claim 1, wherein the gravity-controlled recovery process comprises Steam-assisted Gravity Drainage (SAGD).

17. The method of claim 1, wherein the infill producer well and the adjacent well pairs are substantially horizontal.

18. The method of claim 17, wherein the trajectories of the substantially horizontal infill producer well and the adjacent well pairs are approximately parallel.

19. The method of claim 1, wherein the adjacent well pairs comprise a substantially horizontal completion interval, and a series of substantially vertical infill producer wells are placed with completion intervals along at least a portion of the adjacent well pairs.

20. The method of claim 1, wherein the infill producer well and the adjacent well pairs, constituting a well group, are provided on a repeated pattern basis either longitudinally or laterally or both, to form a multiple of well groups.

* * * * *